US005775016A

United States Patent [19]

Chien

[11] Patent Number: 5,775,016

[45] Date of Patent: Jul. 7, 1998

[54] ILLUMINATED SAFETY GUIDE

[76] Inventor: Tseng-Lu Chien, 8F, No. 29, Alley 73, Lin-Shen Street, Shi-Chi Town, Taipei, Hseng, Taiwan

[21] Appl. No.: 803,767

[22] Filed: Feb. 24, 1997

Related U.S. Application Data

[63] Continuation of Ser. No. 498,258, Jul. 3, 1995, abandoned.

[51] Int. Cl.[6] ..... G09F 13/22

[52] U.S. Cl. ..... 40/544; 40/542; 362/84; 362/812; 362/570

[58] Field of Search ..... 40/542, 544, 570; 362/84, 103, 310, 311, 812

[56] References Cited

U.S. PATENT DOCUMENTS

| | | | |
|---|---|---|---|
| 2,858,632 | 11/1958 | Caserio et al. | 40/544 |
| 2,975,318 | 3/1961 | Nicoll | 40/544 |
| 3,153,745 | 10/1964 | Gurian et al. . | |
| 3,317,722 | 5/1967 | Whitney | 362/84 X |
| 3,940,865 | 3/1976 | Mori | 40/542 |
| 4,401,050 | 8/1983 | Britt et al. | 40/570 X |
| 4,420,898 | 12/1983 | Moses | 40/544 X |
| 4,443,832 | 4/1984 | Kanamori et al. . | |
| 4,466,208 | 8/1984 | Logan, Jr. et al. | 40/544 |
| 4,494,326 | 1/1985 | Kanamori . | |
| 4,864,473 | 9/1989 | Tokarz et al. . | |
| 4,895,110 | 1/1990 | LoCascio . | |
| 5,018,290 | 5/1991 | Kozek et al. | 40/570 |
| 5,151,678 | 9/1992 | Veltri et al. . | |
| 5,245,516 | 9/1993 | de Haas et al. . | |
| 5,245,517 | 9/1993 | Fenton . | |
| 5,317,488 | 5/1994 | Penrod . | |
| 5,327,587 | 7/1994 | Hurwitz . | |
| 5,542,200 | 8/1996 | Matsuoka | 40/544 X |

FOREIGN PATENT DOCUMENTS

| | | |
|---|---|---|
| 0 166 345 | 1/1986 | European Pat. Off. . |

*Primary Examiner*—Brian K. Green
*Attorney, Agent, or Firm*—Bacon & Thomas

[57] ABSTRACT

A illuminated safety guide is made up of a fixture including a housing and a super thin lighting element in the form of an electro-luminescent strip, a photo-luminescent panel, or a combination of an electro-luminescent strip and PL panel. When the EL strip and PL panel are combined, the resulting illuminated safety guide can still be seen even when power to the EL strip is cut-off, the patterns formed by the EL and PL strips being negatives of each other.

14 Claims, 11 Drawing Sheets

FIG. 3
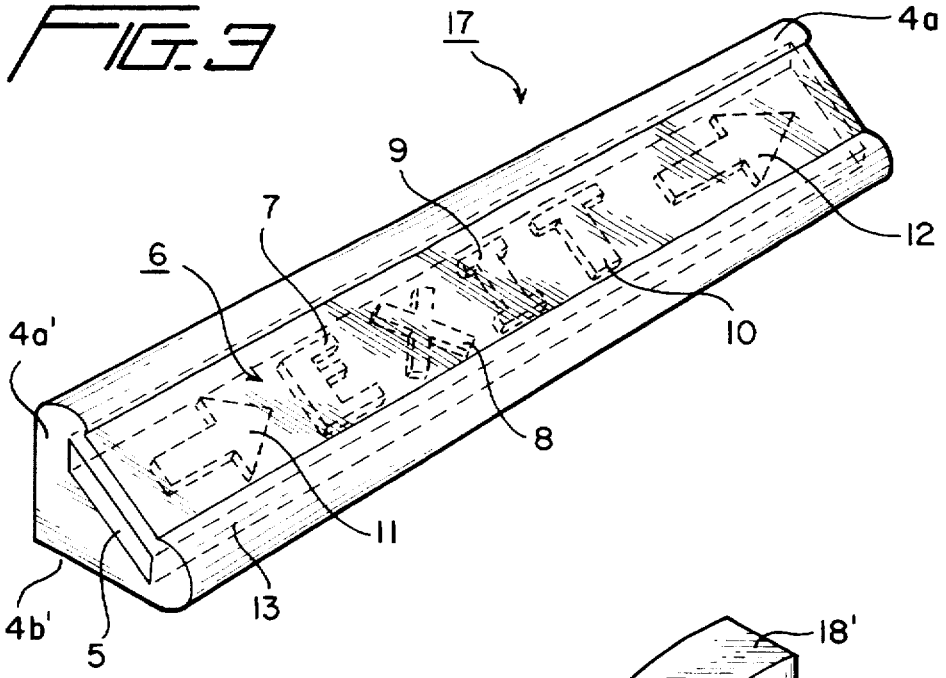
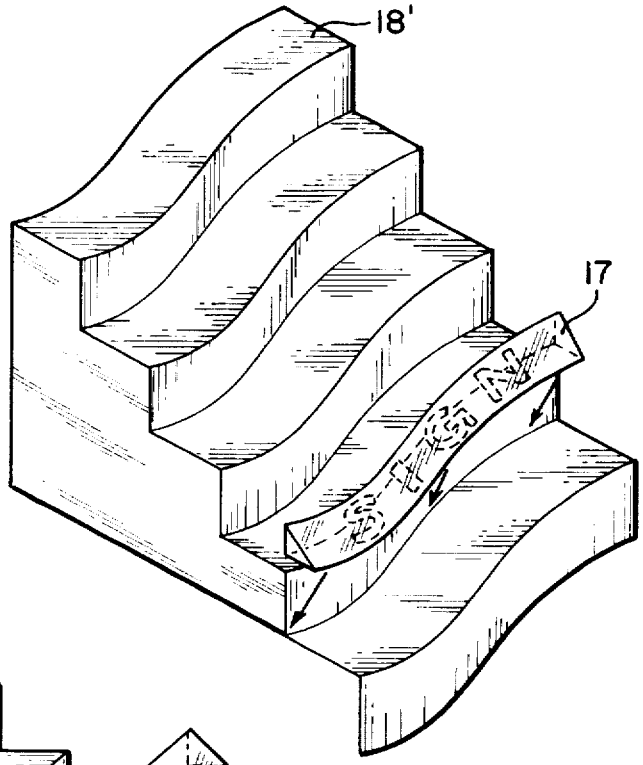
FIG. 4A
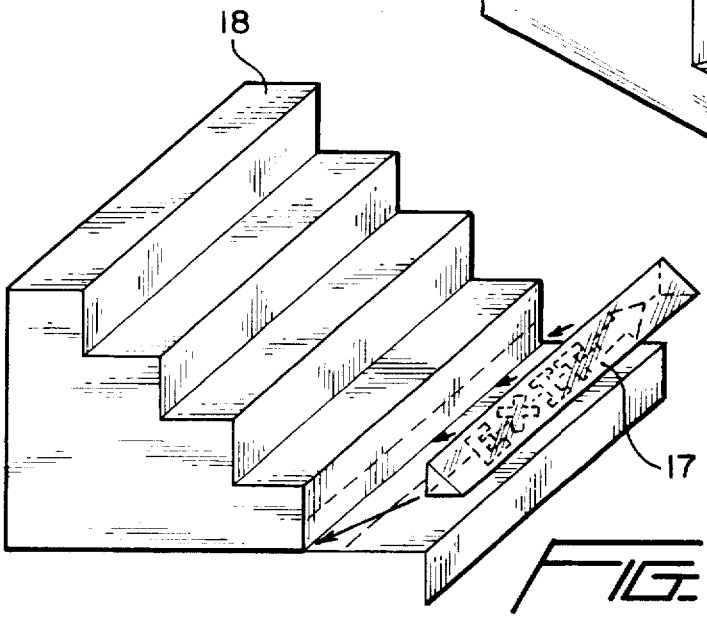
FIG. 4

ILLUMINATED SAFETY GUIDE

This application is a continuation of application Ser. No. 08/498,258, filed Jul. 3, 1995, now abandoned.

BACKGROUND OF THE INVENTION

1. Field of the Invention

This invention relates to an illuminated fixture of the type which serves as a guide for persons or vehicles in poor lighting conditions, and thus is referred to herein as an illuminated safety guide. Such illuminated safety guides may, for example, be used to illuminate theater aisles, hallways, stairwells, and freeway offramps.

2. Discussion of Related Art

The present invention is intended to address several related problems. While stairwells and freeway offramps may appear to be unrelated, it is believed that the relationship will become clear upon reading and understanding the following specification and accompanying drawings. The common thread is the illumination of areas of passage, so as to prevent those passing through from tripping or hitting the sides of the passage, and the common problems are cost, convenience, and the maintenance of lighting even when the power supply fails, so as continue the illumination during emergencies. These and other problems addressed by the present invention are described in more detail as follows:

Problem #1—Providing guidance for persons in buildings and other enclosed spaces This problem concerns the lighting found in the aisles of theaters, stadiums, concert halls, stairwells, airplanes, and other relatively dark indoor environments. The purpose of such lighting is to assist individuals in making their way to their seats and to provide illumination of the escape route during emergencies.

Currently, incandescent or fluorescent lighting is used for this purpose. However, such lighting installations require wiring to be provided for each lighting installation, which entails running wiring under the floor along the aisles to each installation, greatly increasing construction costs and making maintenance difficult. Conventional installations are also subject to breakage during emergencies, and failure during power outages, which is when the lighting is most needed.

In addition, such lighting arrangements do not provide adequate guidance in finding the exits for persons who do not know the way, or who are in a panic situation. In public places with more than one room and corridors, such as nightclubs, karaoke houses, and beauty salons, most customers do not take the time to memorize exit routes, and can easily get disoriented or lost if the path requires several turns and a substantial distance. This problem has been referred to "building blindness," and can have tragic consequences in case of fire, earthquakes, bombings, gas leakage, and other situations where a building, train, airplane, or ship must be evacuated quickly and persons are likely to panic.

Problem #2—Exit signs

This problem concern the illuminated exit signs which are required by law in most public buildings. Like the above-mentioned aisle and corridor lighting, illuminated exit signs conventionally use incandescent bulbs or fluorescent tubes as the light source and thus can easily be broken by vibrations from an earthquake, bomb blast, or panicking people.

To protect the conventional exit signs from damage, at least from the feet of fleeing or panicking individuals, and to ensure visibility, the conventional signs are usually placed above the door or stairway which provides the exit. This is particularly disadvantageous in the case of a fire because smoke from a fire generally accumulates first at the ceiling and will obscure any sign thus placed long before the escape route is closed.

Problem #3—Highway exit ramps

This problem concerns roadside illumination to provide drivers with an indication of the curvature of the road ahead, particularly in the case of freeway exits or offramps. While conventional lighting arrangements, usually in the form of mercury vacuum lamps installed on the street every 100 feet with a height of about 30 feet above the ground to protect them from damage, are generally satisfactory for pointing out the existence of a highway offramp or exit, it is still difficult to judge the curvature of the ramp, and thus many people are hurt or killed because they take the ramp too fast for the curvature of the ramp. Also, in certain weather conditions such as fog, the lights are impossible to see, while most signs which warn of a maximum speed are unlighted, and may be missed by a driver who is tired or impaired in some way.

One solution is to use reflectors, which can be placed at street level, to offer some definition of a curve in a street, but reflectors are generally not bright enough to protect persons travelling at highway speeds, are invisible unless directly in the path of a headlight, and are difficult to see in inclement weather.

Another solution is to use a product known as the Light Tube, which is a tradename of the 3M Company, for the purpose of roadside illumination. The Light Tube uses a super bright bulb such as a 50 Watt halogen bulb on one side of the tube, and fiber optics in the tube, to distribute the light along the tube, thereby providing a flexible installation suitable for exit ramps and other curved road areas. However, this design is too costly to be implemented on a widespread scale, and can only be used in urban areas where an adequate power supply is readily available. In addition, the fragility and high temperature of this type of light can itself present a hazard to pedestrians when the light is place at ground level.

Super thin lighting elements

As part of the solution to the above problems, the present invention proposes to use so-called "super thin lighting elements" as the light source in a lighted safety guide. The phrase "super thin" lighting element refers to a lighting element type containing a chemical sandwiched between protective layers, such as an electro-luminescent (EL) or photo-luminescent (PL) strip or panel. Such lighting elements typically have a thickness of less than ten millimeters, which explains the term "super thin."

Super thin lighting elements of the type described above offer a number of advantages over conventional lighting elements such as incandescent light bulbs and light emitting diodes. These advantages include 1.) flexibility, which allows the lighting elements to follow curves on the object to which they are attached and to survive being stepped on or kicked if placed low to the ground for use as an exit sign visible even if smoke fills the upper portion of the passage, 2.) the ability to be shaped into different designs and printed or silk-screened with logos, marks, figures, and characters, or to be stenciled or masked, which allows super thin lighting elements to be used to provide information in addition to their illumination function, 3.) a wide variety of color choices, including green, blue, pink, yellow, and white, which allows superthin lighting elements to be used for a variety of different guiding purposes and increases attractiveness while avoiding conflict or confusion with other warning signs, 4.) low power consumption in the case of EL strips which enables the strips to be powered by an inexpensive battery pack without the need for connection to the power grid, and zero external power consumption in the case of PL strips or panels, and 5.) low assembly and installation costs.

Although highly advantageous in comparison with light sources conventionally used in safety guides, however, the two main types of super thin lighting element have certain disadvantages. EL lighting elements are relatively bright, but will not work when the power is cut off, as is likely to happen during an emergency. PL lighting elements, on the other hand do not depend on the maintenance of power, but are not as bright and are not available in as wide a range of colors.

SUMMARY OF THE INVENTION

It is accordingly an objective of the invention to provide an illuminated safety guide of the type used to illuminate a passage for persons or vehicles, and which does into suffer the disadvantages of conventional incandescent or fluorescent safety guide arrangements.

It is also an objective of the invention to provide an illuminated safety guide for use in illuminating indoor passages such as aisles, corridors, hallways, and stairwells which does not require wiring to each installation, and which is not likely to be broken as a result of shocks due to earthquakes, bomb blasts, the feet of fleeing persons, and other hazards.

It is another objective of the invention to provide an illuminated safety guide which is not only capable of illuminating a passage, but also provide information concerning the direction to be taken by persons in the passage.

It is a yet another further objective of the invention to provide an illuminated exit sign which is highly visible and yet can be placed at floor level because of increased durability so as to be visible even when the upper portion of the passage is obscured by smoke.

It is a still further objective of the invention to provide a roadside illumination arrangement for delineating curves or offramps without the need for connection to an external electric power line, and which is relatively inexpensive and does not present hazards to passerby even though situated at ground level so as to be more visible in inclement weather.

Finally, it is also an objective of the invention to provide an illuminated safety guide having a light source that combines the respective advantages of both EL and PL lighting arrangements, namely brightness and the elimination of dependence on a power supply.

These objectives are accomplished, according to a first aspect of the invention, by providing an illuminated safety guide which utilizes a super thin lighting element as the light source.

In an especially preferred embodiment of the invention, the super thin lighting element is made up of a combination of PL and EL particles laminated to a sheet, or multiple sheets, each with a different type of particle and relatively arranged to form a pattern visible when either of the particles is activated.

The combined PL and EL lighting element not only has the advantage of brightness and protection in the case of power failure, but also has the advantages common to both types of lighting element, namely the flexibility to be easily attached to a variety of planar and curved surfaces, relative softness so as to prevent injuries upon impact between the safety guide and a person, durability and the ability to withstand shocks and vibrations, a low power consumption of from 0.5 to 100 ma (0.09 ma/cm$^2$) drawn soley by the EL strips or panel and not by the PL strips or panels, the capability of using any mechanical or electrical switch and a variety of different light performances, the availability of a variety of colors with relatively high brightness, and the ability to be printed with a variety of different designs, logos, and so forth. In addition, the invention can make use of optical effects to further increase the lighting effect.

The principles of the safety guide of the present application can be applied to a variety of different indoor safety lighting situations, including "EXIT" signs, illuminated light tubes, lighted floor tiles, lighted anti-slide strips for stairs, guide rails, and so forth. Each application can have an appropriate message such as distance to exit, direction, floor number, and so forth, and can even provide a map of the way out, and the fixture itself can have any desired shape.

The principles of the safety guide of the present application can also be used in a variety of outdoor situations, in the form for example of a lighted tube, board, or sheet applied to roadside barricades, curb lighting, Jersey walls, highway ramp guard rails, traffic cones, and so forth, with power provided by a completely independent power source such as a battery or a generator powered by solar, wind, geothermal, oil, or other power source available in areas not convenient to the power grid.

BRIEF DESCRIPTION OF THE DRAWINGS

FIG. 3 is a perspective view of a variation of the safety guide illustrated in FIG. 1.

FIGS. 4, 4A, 5, and 6 are perspective views showing various indoor applications of the safety guide of the preferred embodiment of the invention.

DETAILED DESCRIPTION OF THE PREFERRED EMBODIMENTS

Figure 1:
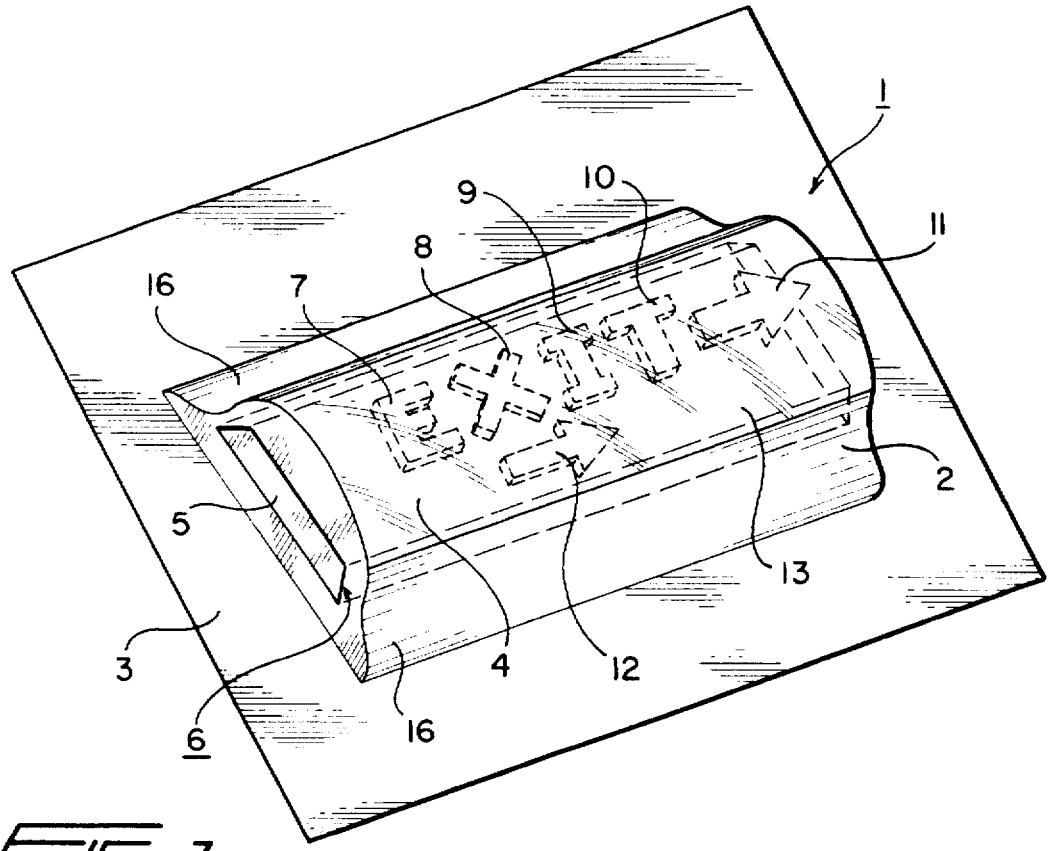
FIG. 1 is a perspective view showing an application of the principles of the preferred embodiment of the invention to a safety guide in the form of a floor mounted "EXIT" sign.

FIG. 1 shows one example of a safety guide constructed in accordance with the principles of a preferred embodiment of the invention. The safety guide illustrated in FIG. 1 is a floor mounted installation 1 made up of a mounting fixture 2 arranged to be mounted on floor 3, and includes a housing 4 and a light strip 5 inserted into a slot 6 in the housing. The housing 4 may be mounted to the floor by any convenient means, including glue, ultrasonic or thermal welding, double sided tape, stitching, Velcro™, hook and eye fastening tape screws or rivets, and so forth.

In this application, the light strip itself is a two part design having elements 7–12 made up of an EL material and an element 13 made up of a PL material. The EL material may, for example, be in the form of a plurality of strips cut in the shape of the letters E, X, I, and T, and also in arrowhead shapes, and can come in a variety of colors. The PL material can be provided in the form of a background panel having a different color than the EL elements, and on which the EL elements are mounted, the EL elements serving as a mask to block the light from the PL element and thereby form the word "EXIT" even when the EL elements are not lit. In addition, to enhance the lighting effect, the housing 4 can serve as an optical element to magnify the shapes provided by the EL elements by making a portion of the housing have a convex shape, and also as a housing for the circuitry which supplies power to the EL elements.

Figure 2:
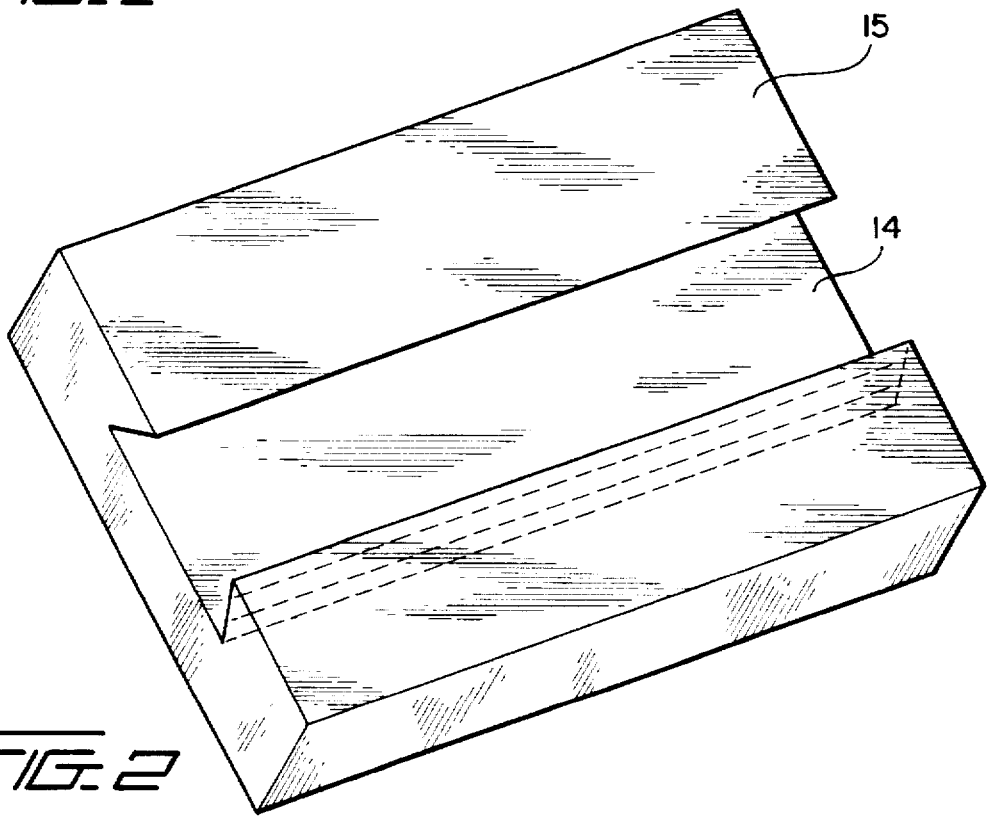
FIG. 2 is a perspective view of a mounting arrangement for the safety guide illustrated in FIG. 1.

As shown in FIG. 2, although the lighting fixture 2 of this implementation of the preferred embodiment can be mounted to a planar floor surface, the floor surface itself could also be modified to facilitate installation, for example by providing a groove 14 in a floor tile 15 arranged to accommodate shoulders 16 of housing 4.

The lighting installation 17 illustrated in FIG. 3 is similar to that shown in FIG. 1, except that the housing 4*a* includes perpendicular surfaces 4*a*' and 4*a*" arranged to facilitate mounting of the fixture on a staircase 18 or as molding between a wall and the floor, as illustrated in FIGS. 4 and 4A. FIG. 4A illustrates the point that, if housing 4A is made of an appropriately flexible material, and because of the flexibilty of the lighting element itself, the safety guide 17 can be mounted on a variety of surfaces, including a curved staircase 18'.

Figure 5:
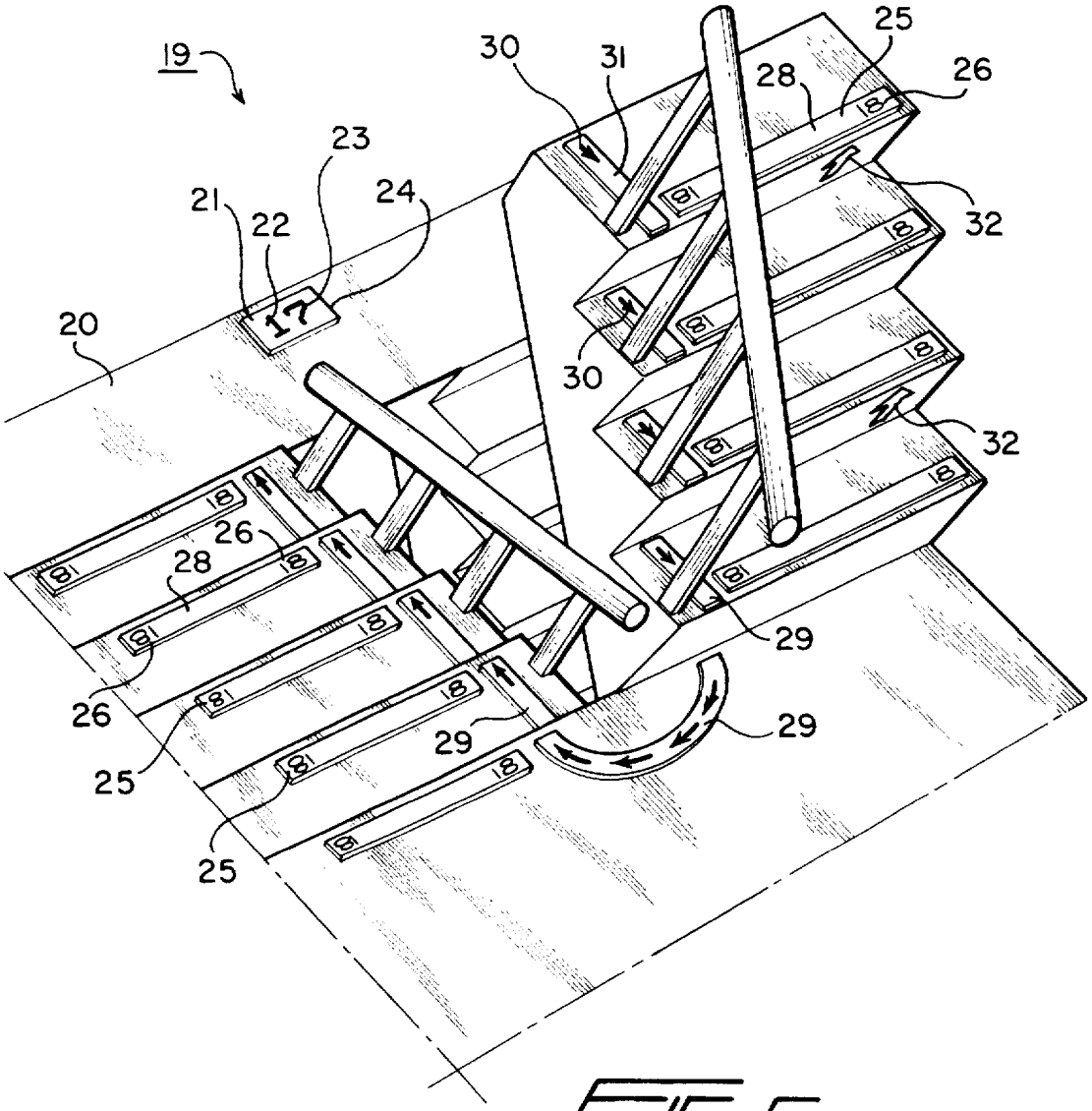

FIG. 5 illustrates the use of a plurality of different types of safety guide installations and the manner in which the versatility provided by the invention can greatly increase the safety effect over a conventional installation, which would at most include a lighted exit sign and conventional lights at spaced intervals in the stairwell. The illustrated application is to a stairwell 19 of the type which might be found in a tall building. At each floor 20, a lighted floor indicator 21 is placed, made up of EL strips 22 and 23 arranged in the shape of the floor number, and a background PL panel 24. On each individual step an illuminated anti-slip strip 25 indicative of the next floor is placed, so as to illuminate the edge of the step while at the same time indicating location. Again, the numbers may be formed by EL strips 26 and 27, and the background by a PL panel 28 (or vice versa). Also provided are strips 29 having arrows formed by EL strips 30 with a PL background panel 31, and individual EL or PL markers 32 as desired. Those skilled in the art will appreciate that this lighting arrangement represents a significant increase in safety without requiring any additional wiring since the individual strips and panels can all have their own individual power supplies, and that the strips also provide additional information which conventional arrangements are unable to provide, such as the use of arrows to remind persons to stay to the right when ascending or descending the stairs.

Figure 6:
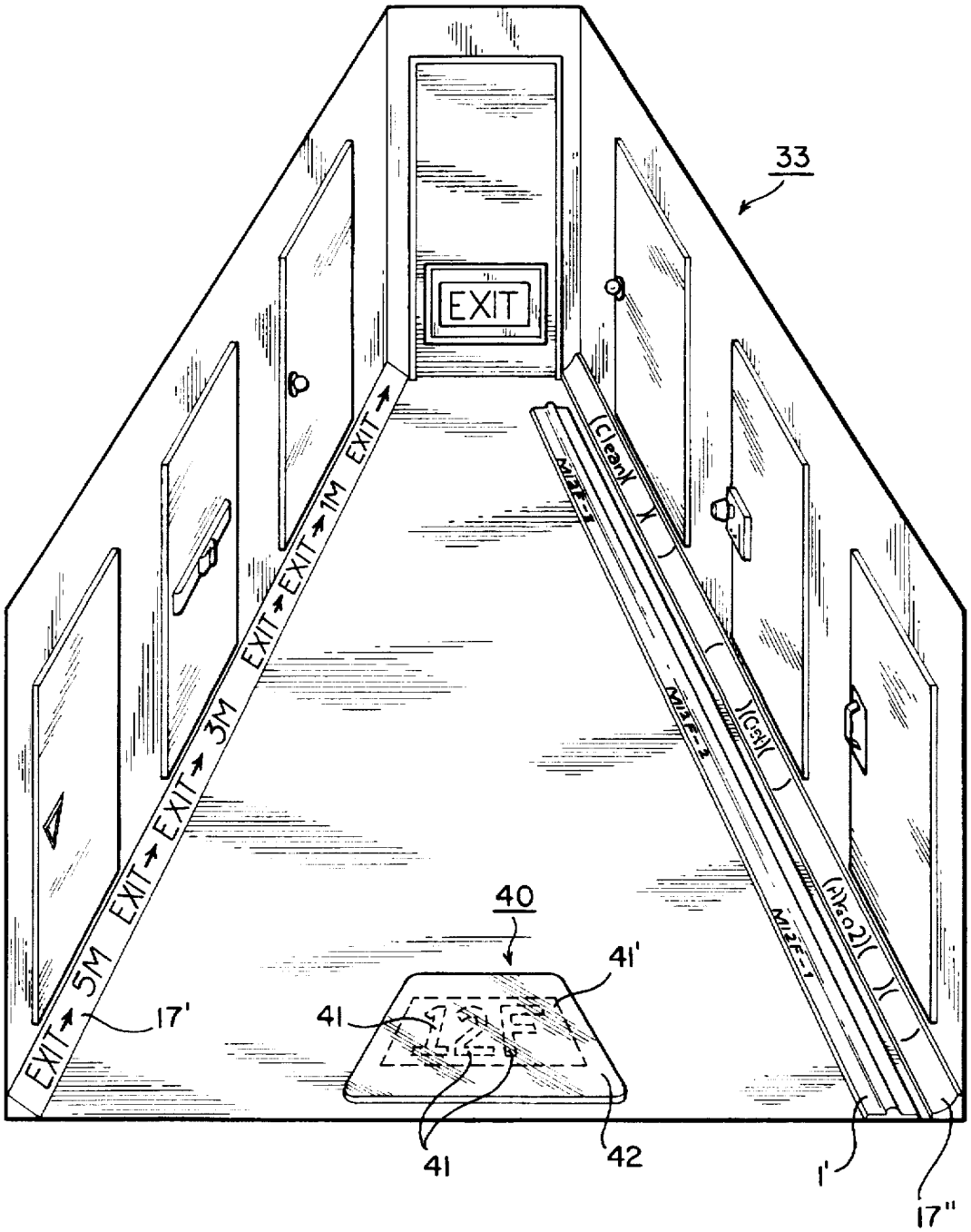
Figure 7:
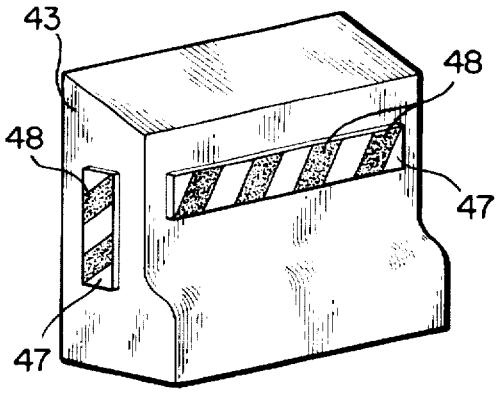
FIGS. 7–11 are perspective views illustrated various roadside applications of the safety guide of the preferred embodiment of the invention.
Figure 8:
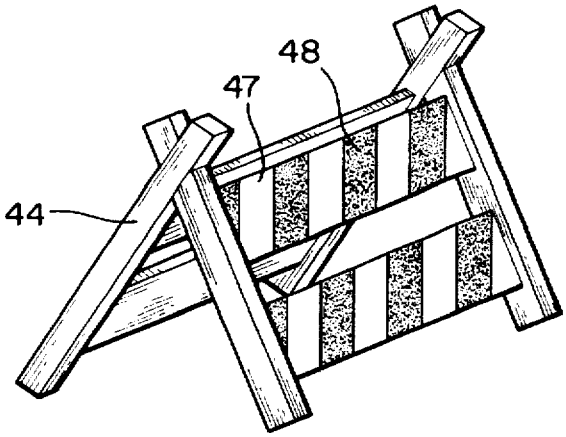
Figure 9:
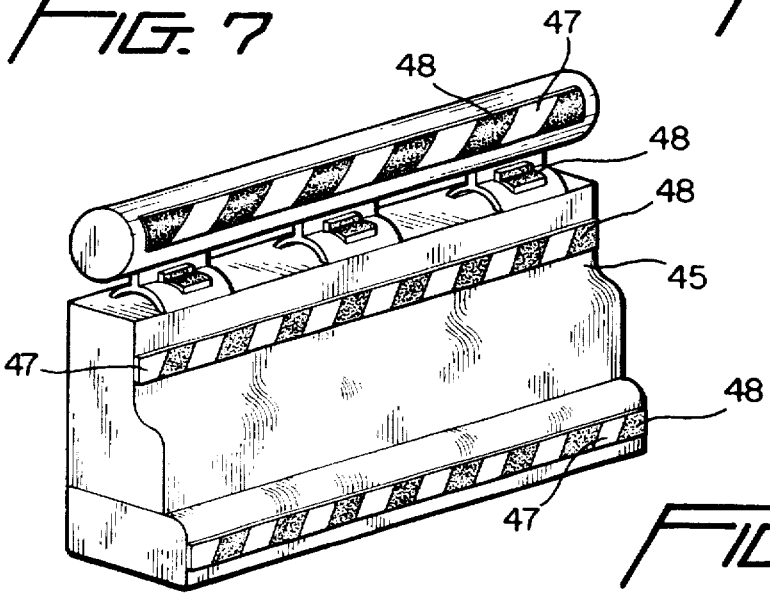
Figure 10:
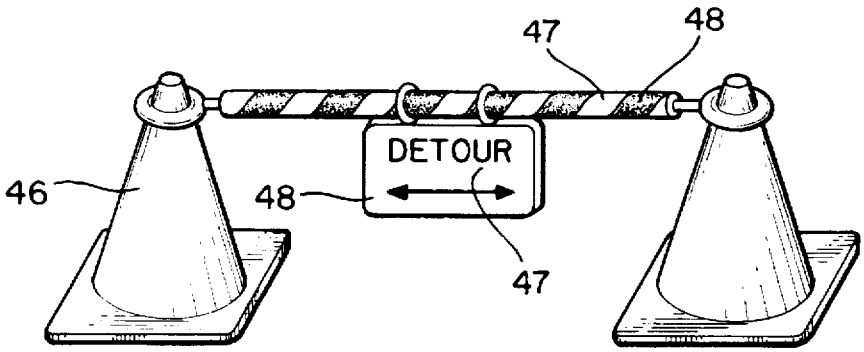

Similarly, FIG. 6 illustrates the use of a plurality of different implementations of the safety guide of the preferred embodiment of the invention in connection with the hallway 33 of a building. Included are an exit indicator molding strip 17' with indications 34 of the distance to the exit, an "Exit" sign 35 which is larger than the conventional exit sign and which is placed on the lower side of the door so as to be visible when smoke fills the upper part of the hallway, a floor mounted strip 1' which give room number information, at the right side of the hallway as seen in FIG. 6, another molding strip 17" with various illuminated markings 37 giving information about the rooms, as well as an illuminated hallway number indicator 40 in the form of a panel in which the numbers are formed by EL strips 41 on a PL backing panel with a transparent Mylar protective layer 42.

Figure 11:
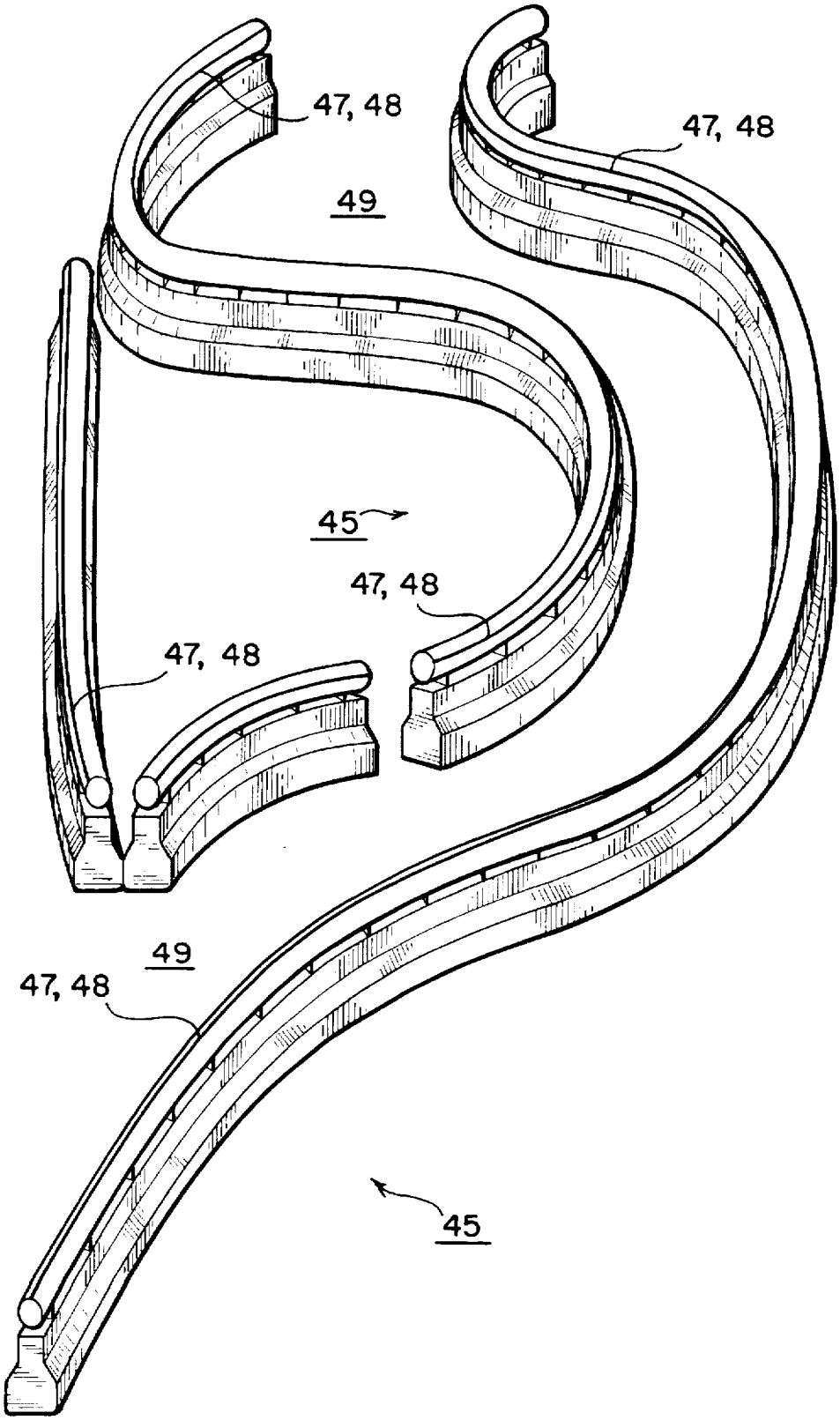

FIGS. 7–10 illustrate various applications of the safety guide of the preferred embodiment of the invention to roadside installations such as a jersey barrier 43, street barricade 44, guard rail installation 45, and traffic cone/barrier set up 46. In each case, the safety guides may, for example, include alternating PL strips 47 and colored EL strips 48. Also illustrated is a detour sign in which the letters may be formed by either PL or EL strips and the background by a corresponding EL or PL panel. Because of the flexibility of the preferred design, the lighting elements can be placed on a wide variety of straight and curved surfaces and have a larger size than conventional lighting elements. This is especially important in an implementation such as the one shown in FIG. 11, which is a freeway offramp 49, in which the offramp is delineated by safety guide installations on guardrails of the type shown in FIG. 9.

Figure 12:
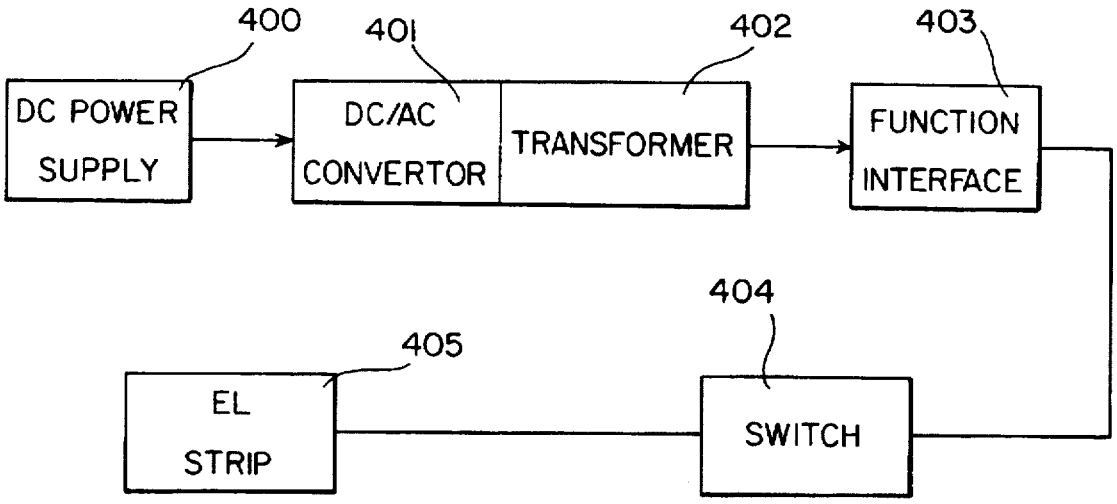
FIG. 12 (PRIOR ART)
FIG. 12 is a block diagram of a control/power supply arrangement suitable for use in connection with the safety guide of the preferred embodiment of the invention.
Figure 13:
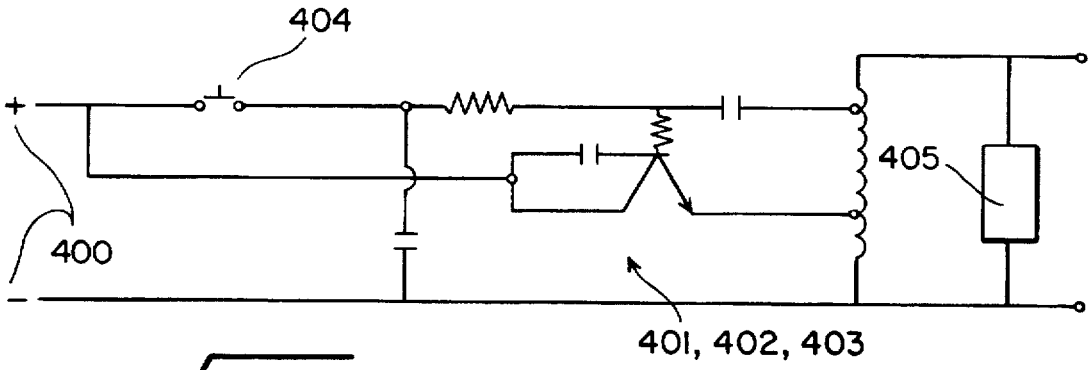
FIG. 13 (PRIOR ART)
FIG. 13 is a schematic diagram of a circuit corresponding to the block diagram of FIG. 13.

FIGS. 12 and 13 illustrate an exemplary circuit for supplying power to the EL strip portions of the preferred super thin lighting elements. In this exemplary circuit, DC power supply 400 is electrically connected to the lighting element 405 via a circuit which includes a DC/AC converter 401 electrically connected with a transformer 402, transformer 402 being further electrically connected with a function interface 403 and, via parallel connected switch 404, to the lighting element 405. Those skilled in the art will appreciate that the DC power supply in this embodiment of the invention can be a rechargeable battery which can be charged by a device having a higher voltage output than the battery's, and that the direct current supplied by DC power source 400 is thus converted into an alternating current of a desired frequency by DC/AC converter 401 and supplied to the transformer 402 for increasing the voltage of the alternating current, and then transmitted from the transformer 402 to the function interface 403. Function interface 403 provides a number of preset or switchable options for turning on the lighting element 405, e.g., steady, flash, sequential or random, and may take any desired form from a simple circuit as illustrated in FIG. 13 to a microprocessor, depending on the complexity of the special effects to be exhibited.

Figure 14:
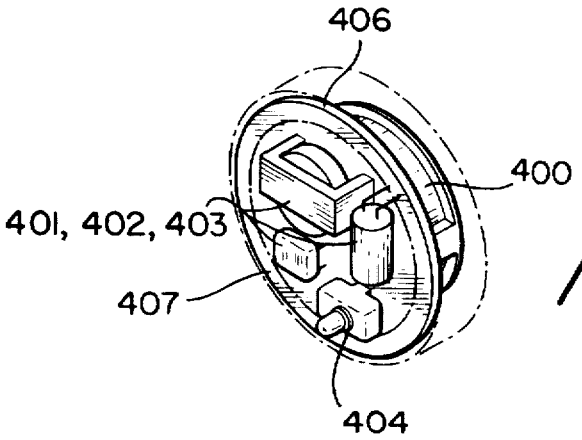
FIG. 14 (PRIOR ART)
FIG. 14 is a perspective view of a power pack suitable for use with the safety guide of the preferred embodiment of the invention.

Each of the components shown in FIGS. 12 and 13 can conveniently be housed in a compact power pack, illustrated in FIG. 14, although those skilled in the art will appreciate that the power pack could take numerous forms, including being integral with the safety guide itself. In the illustrated embodiment, the power pack includes a housing 406, circuit board 407, a battery 400 on one side of the circuit board, a switch 404 and appropriate control circuitry 401–403 in an especially compact and convenient package.

Figure 15G:
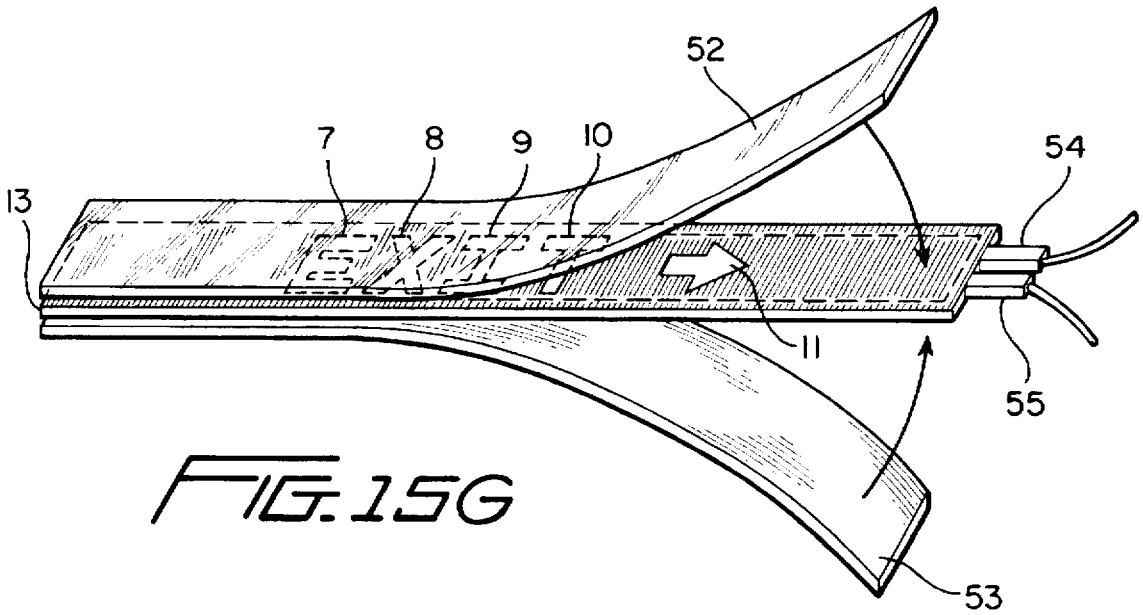
FIG. 15G illustrates the manner in which the light strip of FIG. 15 is constructed.
Figure 15A:
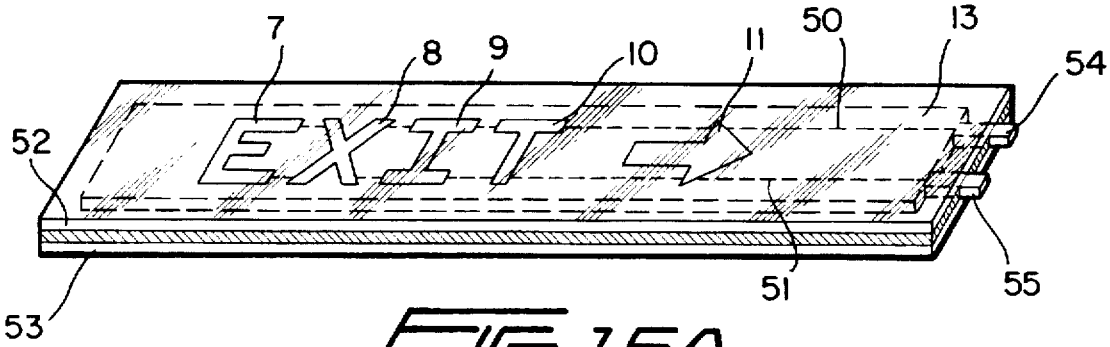
FIG. 15A is a perspective view showing details of the construction of a combined illumination strip constructed according to the principles of the preferred embodiment of the invention.

FIGS. 15A and 15G show in greater detail the compound lighting element illustrated in FIGS. 1 and 3, including a background PL strip 13 through or on the surface of which extends the wiring 50 and 51 for EL strips 7–11 forming the letters of the word "EXIT" and an arrow, the combination of the EL and PL strips being sandwiched by clear sheets 52 and 53 of Mylar from which entend the terminals 54 and 55. This entire assembly may be placed, as shown in FIGS. 15B–15D, inside housings 4 and 4A of different shapes as required, either with (FIGS. 15B and 15C) or without (FIG. 15D) the addition of the Mylar protective layers 52 and 53. In addition, patterns other than the word exit and arrows may easily be added, such as the distance indicators 56 and/or floor designator 57.

Figure 15E:
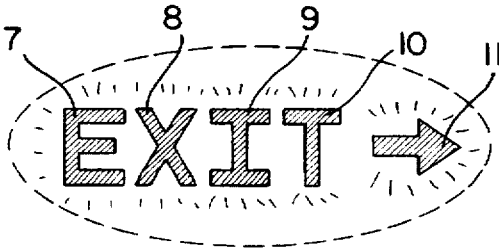
FIGS. 15E and 15F illustrate the operation of the compound lighting strip used in the preferred embodiment of the invention.
Figure 15F:
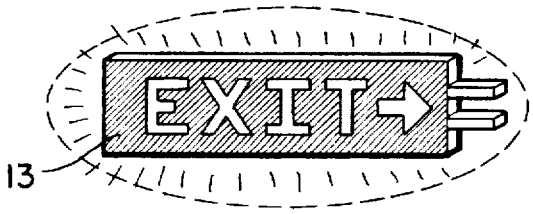
Figure 15B:
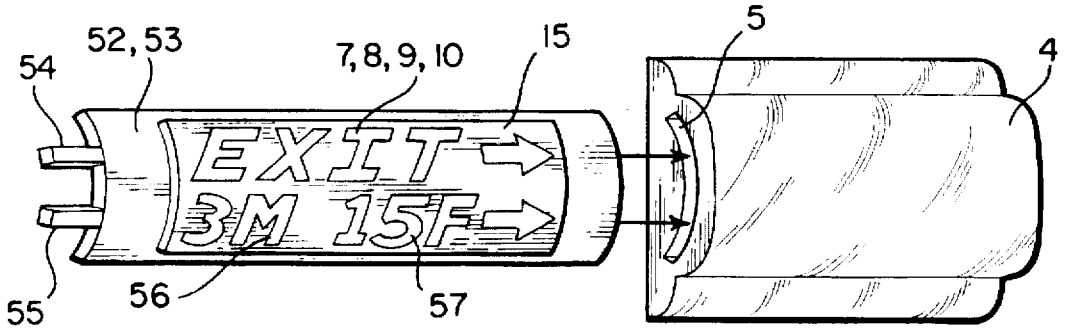
FIGS. 15B–15D show various housing arrangements for the strip illustrated in FIG. 15.
Figure 15C:
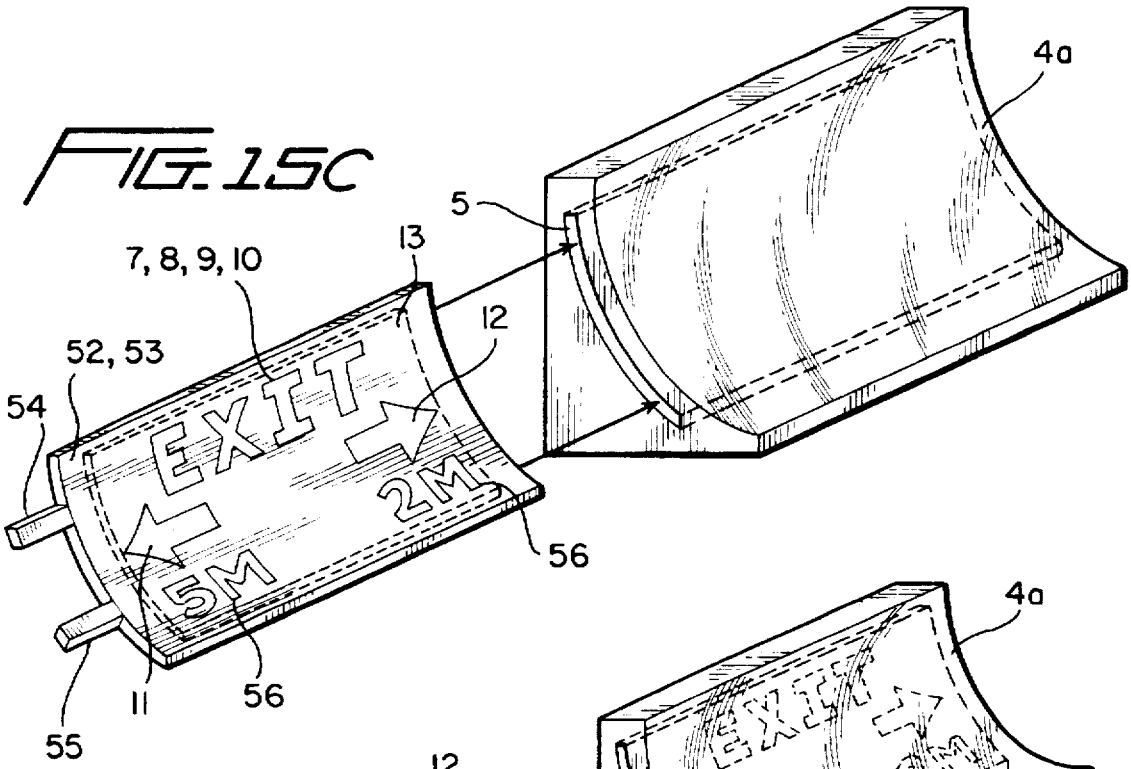
Figure 15D:
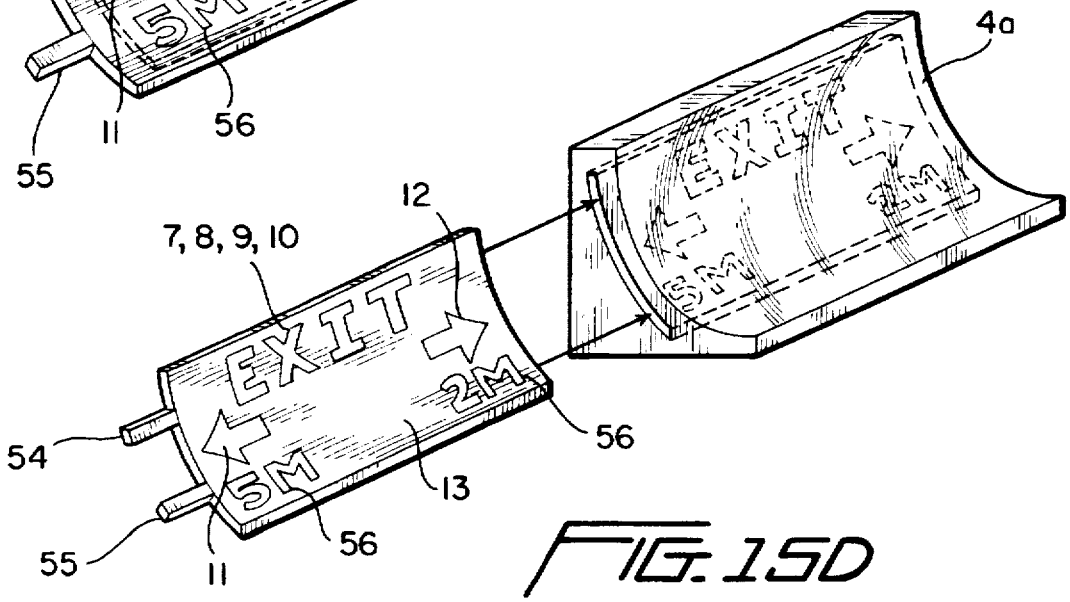

As illustrated in FIGS. 15E and 15F, when the EL strip and PL panel are combined, the resulting illuminated safety guide can still be seen even when power to the EL strip is cut-off, the patterns formed by the EL and PL strips being negatives of each other.

Figure 16:
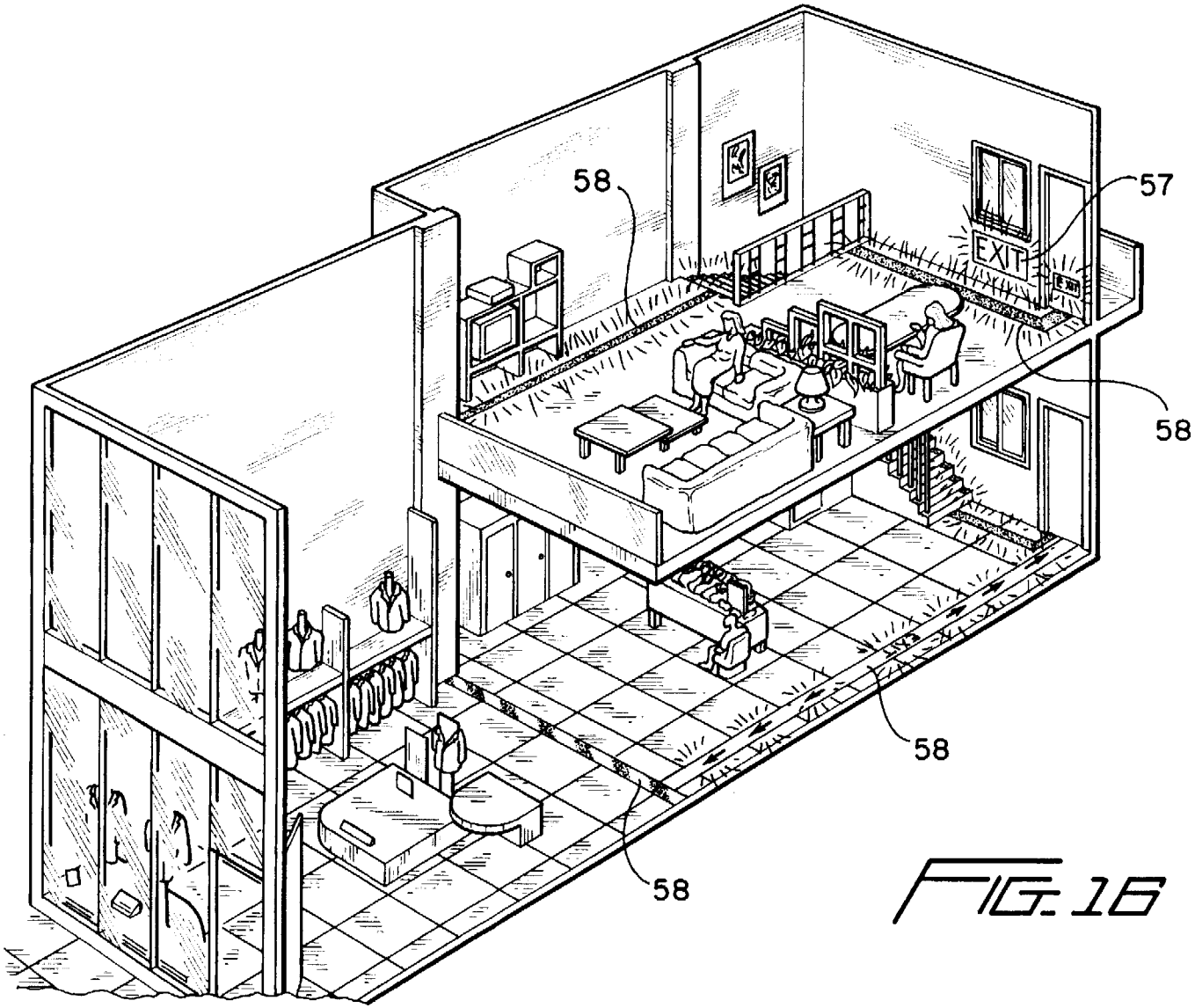
FIGS. 16 and 17 are perspective views showing further applications of the safety guide of the preferred embodiment of the invention.
Figure 17:
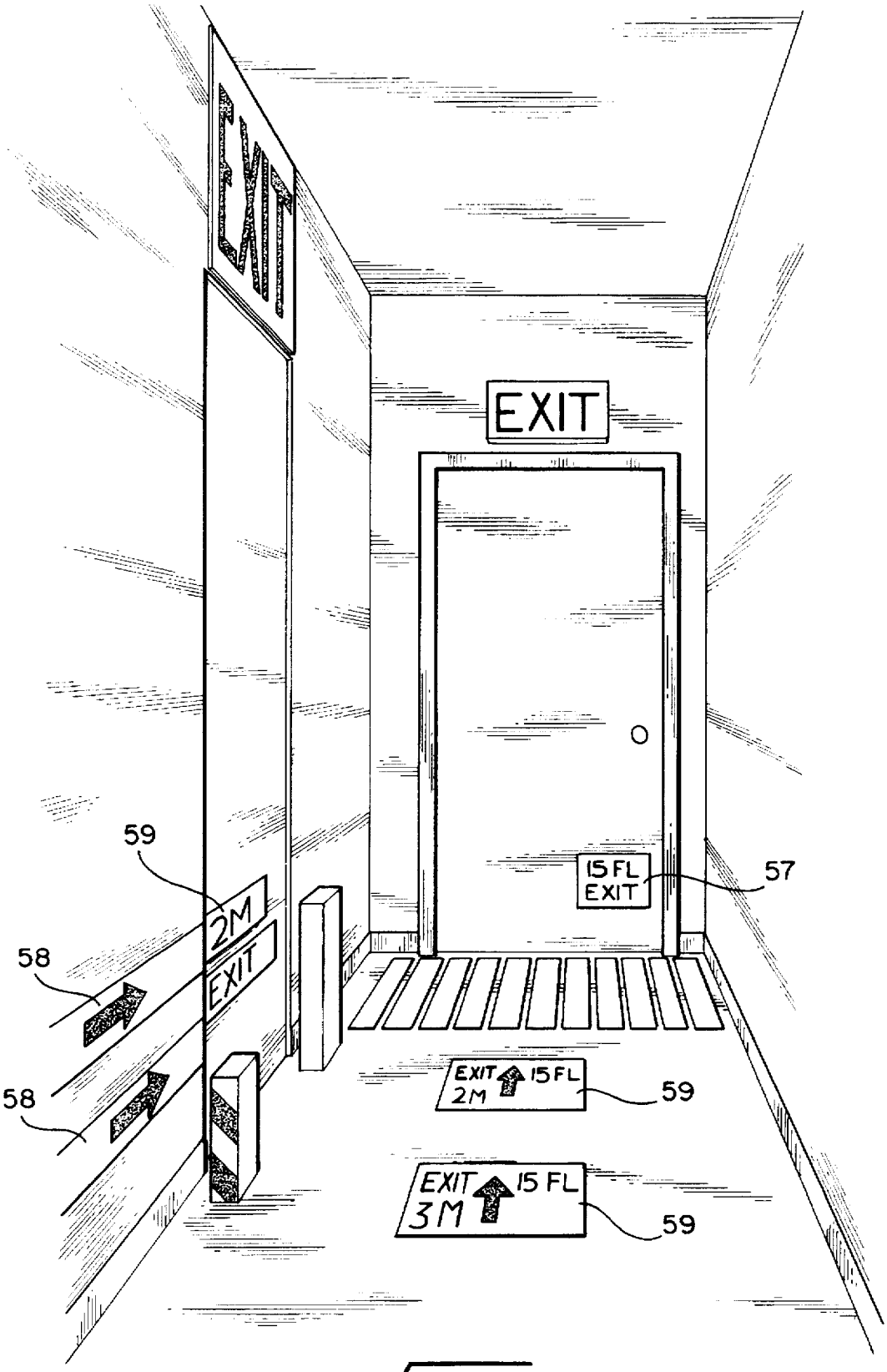

Finally, FIGS. 16 and 17 show further applications of the safety guide of the preferred embodiment of the invention, respectively in a building and in an exit corridor, including an extra large exit sign 57 placed at floor level, exit guides 58, and exit guides with distance indication 59.

Having thus described a preferred embodiment of the invention and a number of variations and modifications of the preferred embodiments, it is anticipated that still further variations and modifications will undoubtedly occur to those skilled in the art upon reading the above description. It is therefore intended that the invention not be limited by the above description, but rather that it be interpreted, in accordance with the appended claims, to cover all such variations and modifications which fairly fall within the scope of the invention.

I claim:

1. A safety guide, comprising:

a housing arranged to be mounted on a surface;

a lighting element within the housing, the lighting element including both electro-luminescent elements and photo-luminescent elements;

means for supplying electrical power to the electro-luminescent elements; and fixing means for fixing the housing to the surface, wherein the electro-luminescent elements and photo-luminescent elements are flexible to facilitate fixing of the housing to a variety of different shaped surfaces, and wherein the electrical power supply means comprises a power source, means for converting power supplied by the power source into a voltage and frequency capable of triggering said electro-luminescent elements, and a function interface including means for turning the electro-luminescent elements on and off according to a predetermined timing pattern, said power source including at least one battery.

2. A safety guide as claimed in claim 1, wherein the electrical power supply is a self-contained power supply.

3. A safety guide as claimed in claim 2, wherein the electrical power supply includes a battery.

4. A safety guide as claimed in claim 3, wherein the battery is a rechargeable battery.

5. A lighted safety guide as claimed in claim 1, wherein the electro-luminescent elements are electro-luminescent particles and the photo-luminescent elements are photo-luminescent particles, the electro-luminescent particles and the photo-luminescent particles being two types of particles, and wherein the electro-luminescent particles and the photo-luminescent particles are laminated on separate sheets, one of the sheets forming a background panel and the other being cut into strips placed on the background panel to form a message, such that when a first of the two types of particles is activated, a positive image of the message is formed, and when the second type of particle is activated but the first type of particle is not, a negative image of the message is formed.

6. A lighted safety guide as claimed in claim 1, wherein the electro-luminescent elements and the photo-luminescent elements are, respectively, electro-luminescent particles and photo-luminescent particles, and the electro-luminescent particles and photo-luminescent particles are mixed together.

7. A lighted safety guide as claimed in claim 1, wherein the lighting element has a pattern formed therein by a pattern forming technique selected from the group consisting of silkscreening, stencilling and masking.

8. A lighted safety guide as claimed in claim 1, wherein the hook and eye fastening tape, and a mechanical fastener.

9. A lighted safety guide as claimed in claim 1, wherein the fixing means comprise means for fixing the housing to a floor tile, and the housing is arranged to fit within a groove in the floor tile.

10. A lighted safety guide as claimed in claim 1, wherein the fixing means comprises means for fixing the housing to a surface of a passage selected from the group consisting of an aisle, hallway, and stairwell, adjacent a floor of the aisle, hallway, and stairwell.

11. A lighted safety guide as claimed in claim 1, wherein the the fixing means comprises means for fixing the housing to a roadside object selected from the group consisting of a jersey barrier, street barricade, guard rail, and traffic cone set up.

12. A lighted safety guide as claimed in claim 1, wherein the housing forms an optical element.

13. A lighted safety guide as claimed in claim 1, further comprising at least one switch connected between the function interface and the power supply to control the timing pattern according to which the electro-luminescent elements are turned on and off.

14. A compound illumination arrangement, comprising:

a photo-luminescent panel; and at least one linear electro-luminescent strip attached to the photo-luminescent panel, wherein the electro-luminescent strip has a predetermined shape and is placed such that the shape is illuminated whether or not power is being supplied to the strip because, when power is not being supplied to the strip, the strip will form a negative image of the predetermined shape as a result of the illumination provided by the photo-luminescent panel, wherein the electro-luminescent elements and photo-luminescent elements are flexible to facilitate fixing of the housing to a variety of different shaped surfaces, and wherein the electrical power supply means comprises a power source, means for converting power supplied by the power source into a voltage and frequency capable of triggering said electro-luminescent elements, and a function interface including means for turning the electro-luminescent elements on and off according to a predetermined timing pattern.

* * * * *